United States Patent [19]

Walter

[11] 4,453,628

[45] Jun. 12, 1984

[54] BACON PACKAGE INNER PAD

[75] Inventor: Richard T. Walter, Norristown, Pa.

[73] Assignee: Container Corporation of America, Chicago, Ill.

[21] Appl. No.: 481,296

[22] Filed: Apr. 1, 1983

[51] Int. Cl.[3] ..... B65D 25/54; B65B 25/06; B65B 3/00

[52] U.S. Cl. ..... 206/45.31; 206/45.33; 229/2.5 R; 229/87 F

[58] Field of Search ..... 206/45.34, 45.31, 45.33; 229/87 F, 2.5 R

[56] References Cited

U.S. PATENT DOCUMENTS

| | | | |
|---|---|---|---|
| 3,700,096 | 12/1972 | Reifers | 206/45.31 |
| 3,756,492 | 9/1973 | Reifers et al. | 206/45.33 |
| 3,803,332 | 4/1974 | Seiferth et al. | 206/45.31 |
| 3,978,260 | 8/1976 | Dobbins et al. | 206/45.33 |

*Primary Examiner*—William T. Dixson, Jr.
*Attorney, Agent, or Firm*—Richard W. Carpenter

[57] ABSTRACT

An inner pad for holding slices of bacon within an outer package and having a window opening and protrusions extending from the underside thereof adjacent the opening.

3 Claims, 3 Drawing Figures

BACON PACKAGE INNER PAD

BACKGROUND OF THE INVENTION

1. Field of the Invention

This invention relates generally to bacon packages, and more particularly to a new and improved inner pad for holding bacon slices within an outer package.

2. Description of the Prior Art

A prior art search in the United States Patent and Trademark Office directed to the subject matter of this application disclosed the following United States Letters Patent Nos: 1,711,372; 3,338,723; 3,357,625; 3,682,365; 3,698,623; 3,700,096; 3,703,384; 3,718,274; 3,734,279; 3,756,492; 3,764,057; 3,803,332; 3,845,896; 3,885,727; 3,885,728; 3,978,620; 4,003,184; 4,162,759.

None of the prior art patents uncovered in the search discloses an inner pad for a bacon package which includes a primary panel having at least one window opening with protrusions or projections extending from the underside of the panel in the area of the opening to space the panel above the surface on which the pad is supported.

SUMMARY OF THE INVENTION

An object of the present invention is to provide a new and improved bacon package which includes a molded inner pad for supporting a plurality of slices of bacon within an outer package.

A more specific object of the invention is the provision, in a bacon package, of an inner pad having at least one window opening for viewing the packaged bacon through the pad itself and having protrusions extending from the underside of the pad to space the pad above the surface upon which the pad is supported during the filling of the package so as to eliminate need for providing a plastic sheet of film on the pad between the window opening and the slices of bacon.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
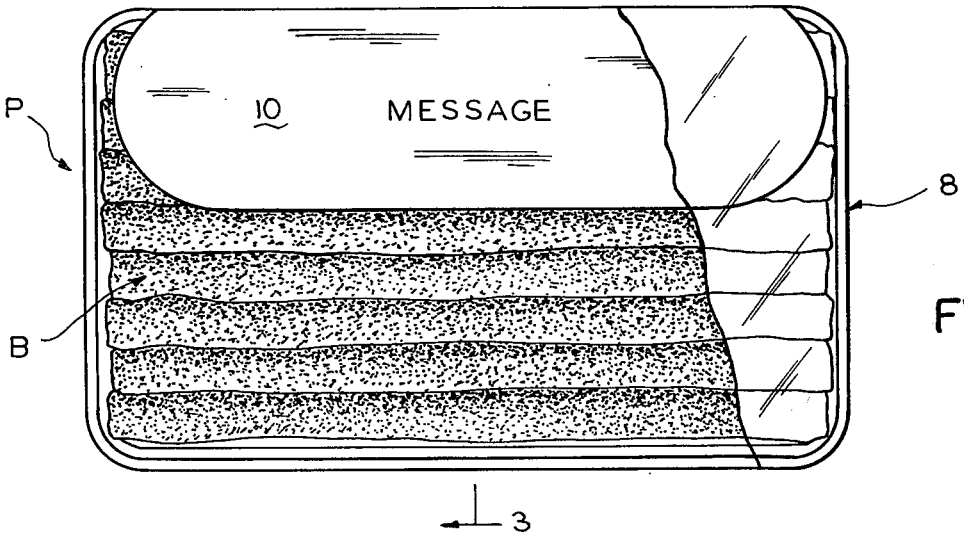
FIG. 2 is a top plan view of the structure illustrated in FIG. 1, with packaged bacon shown in place and with the secondary panel folded over the product.

Referring now to the drawings for a better understanding of the invention, there is illustrated in FIG. 2 an inner pad, indicated generally at P, which is used to hold bacon slices, indicated generally at B. The inner pad, with the bacon in place, is adapted to be placed within a conventional outer package, not shown, having openings which allow viewing of the bacon from both side of the package.

In order to view the bacon through the rear side of the package, it is necessary to provide window-type openings in the inner pad which holds the bacon.

A problem which is frequently encountered during the placing of bacon in packages of this type is that the bacon tends to droop through the openings and engage the conveyor or other surface upon which the pad is being supported.

In order to prevent this from happening, conventional bacon packages of this type are provided with a layer of clear plastic film which is placed on the upper surface of the pad between the pad and the bacon. This prevents the bacon from drooping through the window opening and contacting the surface below.

The present invention eliminates the need for the film by elevating the undersurface of the pad from the surface upon which the pad is supported during the filling of the package.

Figure 1:
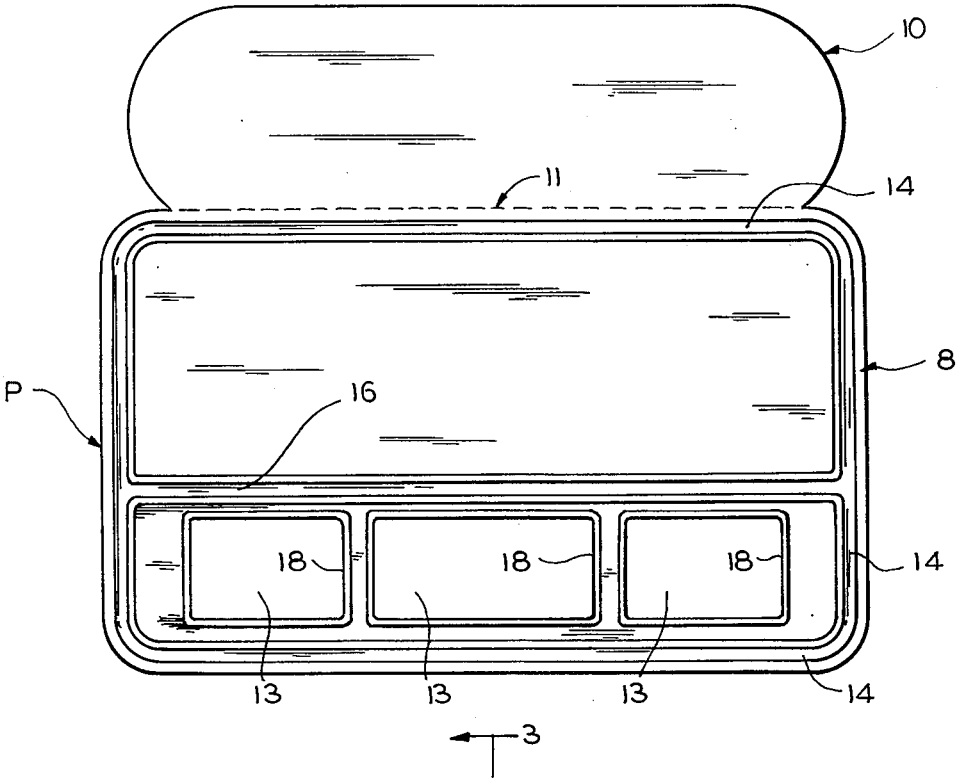
FIG. 1 is a bottom plan view of a bacon package inner pad embodying features of the invention.
Figure 3:
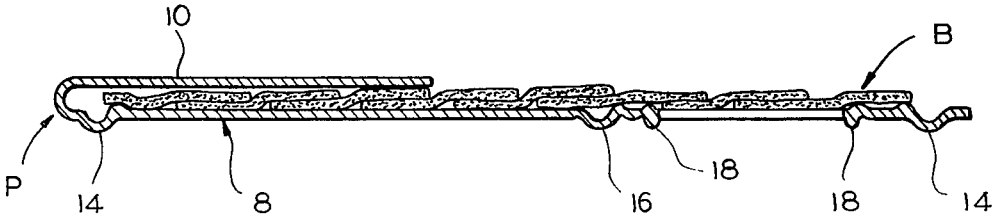
FIG. 3 is a vertical, cross-sectional view taken on line 3—3 of FIG. 2.

As best seen in FIGS. 1 and 3, the pad indicated generally at P includes a preferably rectangular primary panel 8 and smaller secondary panel 10 which is foldably joined along a fold line 11 to one side edge of panel 8.

The panel 8 is provided with one or more window openings 13 extending therethrough and located adjacent the side of the primary panel 8 remote from the side which is attached to secondary panel 10. The panel 8 may be of a relatively thin, flat construction and the secondary panel 10 is adapted to be folded over 180° into overlying relationship with the panel 8 as shown in FIGS. 2 and 3.

In order to space the lower side of the primary panel 8 above a surface on which the pad may be supported during the filling and loading operations, there are provided a plurality of protrusions in the form of ribs or beads projecting downwardly from the underside of the package.

As best seen in FIG. 1, there is a peripheral protrusion or bead indicated generally at 14 which extends all the way around the primary panel 8 and a second rib or bead 6 which extends the length of the primary panel 8 between opposite sides of the peripheral rib or bead 14.

Additionally, as best seen in FIG. 1, there may be provided additional downwardly projecting ribs or beads 18 which are formed immediately adjacent window openings 13.

In order to provide a construction of the type described it has been found that thermo-forming of plastic material or molding of paperboard pulp material accomplishes the desired structure in the simplest and least expensive fashion.

It will therefore be appreciated that the invention provides a unique means of eliminating the need for film on the inside of a bacon package by providing means for spacing the bacon supporting pad above the surface upon which the pad is supported during the packaging operation.

What is claimed is:

1. An inner pad for holding and displaying packaged articles, such as slices of bacon, within an outer package, said pad formed of molded material, such as plastic or paperboard, and comprising:

(a) a relatively thin flat primary panel having adjacent one side thereof a plurality of window openings extending therethrough for having adjacent one side thereof viewing portions of said packaged articles through said panel;

(b) peripheral protrusions extending all the way around said primary panel and projecting downwardly from the underside thereof;

(c) an elongated rib extending the length of said primary panel between opposed sides of said peripheral protrusions; and (d) protrusions projecting downwardly from the underside of said primary panel and located adjacent said window openings which maintain the portion of said panel surrounding said window openings spaced an appreciable distance above a surface on which said panel may be supported.

2. A pad according to claim 1, wherein said pad is thermo-formed of plastic material.

3. A pad according to claim 1, and including a secondary panel of lesser dimensions than said primary panel, said secondary panel being foldably joined at a side edge to a side edge of said primary panel and adapted to be folded over 180° into overlying relation therewith.

* * * * *